US005456462A

United States Patent [19]

Wilson

[11] Patent Number: 5,456,462

[45] Date of Patent: Oct. 10, 1995

[54] FLAG FOOTBALL DEVICE

[76] Inventor: Porter C. Wilson, 5630 N. Via Latigo, Tucson, Ariz. 85704

[21] Appl. No.: 285,453

[22] Filed: Aug. 3, 1994

[51] Int. Cl.[6] ..... A44B 21/00

[52] U.S. Cl. ..... 273/55 C

[58] Field of Search ..... 273/55 C; 24/31

[56] References Cited

U.S. PATENT DOCUMENTS

| | | | |
|---|---|---|---|
| 2,846,224 | 8/1958 | Roselle | 273/55 C |
| 2,966,356 | 12/1960 | Wilson | 273/55 C |
| 2,986,396 | 5/1961 | Abbott | 273/55 C |
| 3,063,718 | 11/1962 | Steinkamp | 273/55 C |
| 3,251,109 | 5/1966 | Wilson | 273/55 C |
| 3,579,745 | 5/1971 | Wilson | 273/55 C |

*Primary Examiner*—Theatrice Brown
*Attorney, Agent, or Firm*—Millen, White, Zelano, & Branigan

[57] ABSTRACT

A belt utilized for flag tag games includes an arrangement for detachably mounting flags thereon by utilizing a support which includes a plug connected to a web retainer by a stem. The plug is receivable in a resilient socket on the belt so as to emit a pop when pulled therefrom. The web retainer has a pair of transverse slots defining a bridge therebetween so that the belt may be passed through one slot and then be passed over the bridge and through the other slot. The flag includes a closed recess in one end thereof through which the plug and stem are inserted to secure the flag to the support. In accordance with one embodiment of the belt, the belt includes a buckle attached to one end, the buckle having a channel or groove adjacent the bottom edge thereof which faces the upper edge. A row of teeth projects from the upper edge toward the groove. A toothed slider, attached to the opposite end of the belt, is inserted laterally into the groove and then tilted into engagement with the teeth in order to provide a fine length adjustment.

5 Claims, 3 Drawing Sheets

FLAG FOOTBALL DEVICE

CROSS-REFERENCE TO RELATED PATENTS

This application is related to U.S. Pat. Nos. 2,966,356, 3,251,109, 3,279,745, 4,304,403 and 4,651,989 issued to the same inventor. The disclosures of these patents are hereby specifically incorporated by references.

BACKGROUND OF THE INVENTION

This invention relates to a novel flag-tag device and to an improved flag coupling and an improved belt buckle embodiment for such a device Games utilizing "chase-catch" instincts are as old as civilization. One of the most elaborate and complicated is the game of football as played mainly in the United States of America. Rules in the game provide fair and equal opportunities to win, and along with the demands of strategy and physical skills, combine to make football a favorite sport in the United States. Unfortunately, this great game has been mostly a "spectator" sport.

The reason for this is that playing of tackle football requires heavy body contact as well as extensive falling and rolling contact with the ground. Thus, the tackle version of the game of football requires much physical conditioning and expensive safety equipment. These are factors which make mass participation in the tackle version of the game impossible.

An alternative version has been played which requires stopping of the ball carrier by a two handed "tag" or "touch", and this, in combination with modified blocking rules has allowed less restricted participation in the game. However, this game becomes less exciting because the ease with which the "touch" or "tag" is made prevents the ball carrier from going forward into or through a group of opponents.

Still another alternative involves stopping the ball player by removing a tail, streamer or flag from the body. However, these flags, in order to make the game exciting, must detach only after use of the same approach as in making a good tackle in the "tackle" version of the game.

The ideal is to provide a set of flag devices which spin, spiral and flutter so as to be elusive, and which ideally requires a pull-away tension of 15–20 lbs. The flags should require an "along-side" approach with a center flap grasp and clean jerk-away to accomplish deflagging. If these standards are required, this will make the game exciting and will make it available for safe mass participation of people of both sexes and all ages. As noted before, such devices are generally illustrated by the above-identified patents of the same inventor.

In prior art flag type games, a flag has typically been attached to the belt or other waist-encircling arrangement of a wearer by releasable coupling parts in a manner such that the flag is pulled away from its attachments to the belt by a predetermined pull-away tension to the belt. This serves to detach the flag coupling part from the cooperative belt coupling part. Normally, these coupling parts have been designed as cooperating ball and socket devices, as shown in U.S. Pat. Nos. 2,966,356; 3,251,109; 3,345,070; and 3,579,745, each of which is incorporated herein by reference.

In a more recent improvement in this type of device as evidenced by the device of U.S. Pat. No. 4,304,403, a ball member is provided with an open-ended through slot to provide resiliency to the cheeks of the ball to permit manual attachment and detachment thereof relative to the socket member. An attachment member is positioned by an angled portion extending outwardly of the belt of a player to secure the end of a game flag or similar game piece thereto.

One belt design which attempts to correct this problem is disclosed in U.S. Pat. No. 3,355,744 and describes a belt and engaging member onto which the excess belt amount can be looped to prevent the belt end from flopping during the games. However, it is often the case that the user will forget to engage the belt in said element, thereby defeating the purpose of this provision.

U.S. Pat. 4,651,989 includes improvements to the buckle members and to the coupling for the flags to provide and enhance the popping sound when the flag is detached.

SUMMARY OF THE INVENTION

It is an object of the present invention to provide a new and improved belt for flag tag games.

In view of this object and other objects, the present invention is directed to an arrangement used in a flag tag game wherein the arrangement comprises a main support for mounting on the body of a player, the main support including a resilient cup-shaped member defining a socket mounted on the support. A flag support is provided including a stem with a plug at one end for detachably seating within the socket on the main support at the other end. The flag support has a web retainer having a pair of slots. A flag for mounting on the flag support has first and second end portions joined by an intermediate portion with a closed recess in the first end portion. The flag is mounted on the flag support by being passed through the slots in the web retainer and by receiving the stem through the closed recess in the first end portion of the flag.

The present invention is further directed to a belt assembly, useful for attaching at least one flag to a player in a flag tag game. The belt assembly includes a slide member having means thereon for securing the first end of the belt thereto and means for retaining lengths of the belt wrapped therearound to provide relatively large adjustments in belt length. The slide has a selected width, a first edge and a second edge with the first edge having a row of teeth therealong. A buckle is attached to a second end of the belt. The buckle has a first edge and a second edge wherein the first edge has a row of teeth proximate thereto projecting toward the second edge and the second edge has a groove opening toward the row of teeth. The distance between the row of teeth and the bottom of the groove is substantially equal to the width of the slide wherein, when the second edge of the slide is inserted into the groove, the teeth of the slide mesh with the teeth of the buckle at a location selected by the user to provide relatively small length adjustments made by engaging the teeth of the belt with the teeth of the slide at different locations.

BRIEF DESCRIPTION OF THE DRAWINGS

Various other objects, features and attendant advantages of the present invention will be more fully appreciated as the same becomes better understood when considered in conjunction with the accompanying drawings, in which like reference characters designate the same or similar parts throughout the several views, and wherein.

Detailed Description of the Invention

Figure 1:
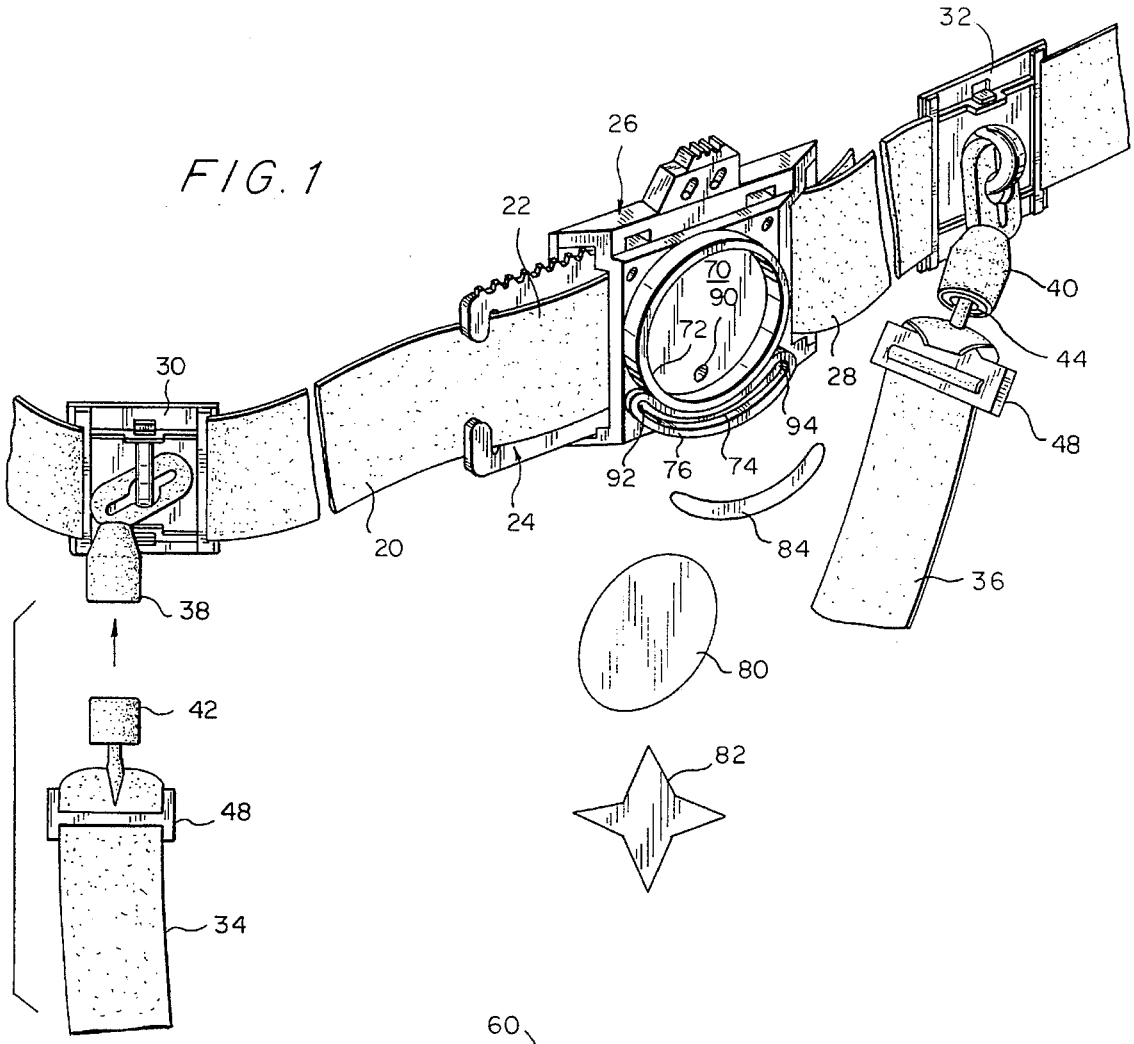
FIG. 1 is a perspective view of the improved flag football device of the present invention.

Referring now to FIG. 1, there is shown the combination of a belt 20 have a first end 22 secured to a slide 24 which is slidably received within a belt buckle 26 to which a second end of the belt 28 is attached. The belt 20 provides a main support for the flag tag apparatus configured in accordance with the present invention. The belt 20 of FIG. 1 is utilized in playing tag football and is broadly similar in configuration to the belt of U.S. Pat. 4,651,989, incorporated herein by reference, and issued to the applicant of this application. Mounted on the belt 20 are slidably adjustable members 30 and 32 which have flags 34 and 36, respectively, coupled thereto by suction cups 38 and 40, respectively. The flags 34 and 36 have plugs 42 and 44 which are received in the cups 38 and 40. When one of the flags 34 or 36 is grabbed by an opposing player and pulled, the respective plug 42 or 44 is released from the respective resilient cup 38 or 40 with a loud pop. This feature is fully explained in applicant's U.S. Pat. 4,651,989.

Figure 2:
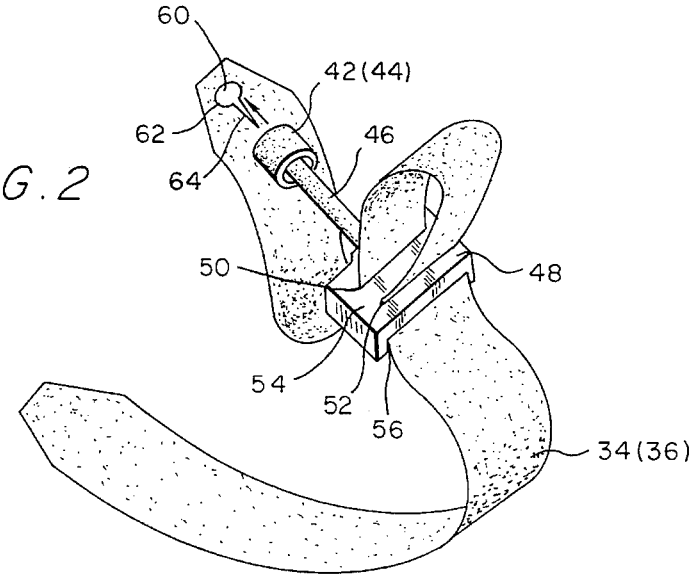
FIG. 2 is a perspective view showing how a flag is attached to a pop-type coupling.

Referring now to FIG. 2, in combination with FIG. 1, there is shown an arrangement for attaching the flags 34 or 36 to the plug 42 or 44 in accordance with the present invention. The plug 42 or 44 is unitary with a stem 46 which is unitary with a web retainer 48. The web retainer 48 has a pair of slots 50 and 52 separated by a bridge 54. The free end of the web retainer has an indentation 56 which facilitates mounting of the flag 34 or 36.

As is seen in FIG. 2, the flag 34 or 36 is passed through the indentation 56 and up through the transverse slot 52. The flag 34 or 36 is then looped over the bridge 54 and passed through the slot 50. A first end of the flag 34 or 36 has a closed recess 60 therein having a circular portion 62 and a longitudinal slit 64. The plug 42 or 44 passes through the recess 60 and the circular portion 62 fits somewhat snugly around the stem 46. The flag 34 or 36 is then pulled to flattened the loop portions and tighten the flag on the stem 46 and on the web retainer 48 so as to snugly fit therewith as is seen in FIG. 1. This provides an arrangement for attaching the flags 34 and 36, wherein the flags may be readily changed if the flags become damaged or worn and if it is desired to provide flags of different colors.

Referring again to FIG. 1, it is seen that the buckle 26 has an enclosed area 70 defined by a rim 72. Beneath the circular area 70, there is a crescent shaped area 74 defined by a crescent shaped rim 76. The area 70 may receive any one of or a plurality of design inserts 80 and 82 which may be of selected colors and configurations while the crescent shaped area 74 may also receive crescent shaped inserts 84 which may also be of various colors and configurations. In order to facilitate removing the inserts 80, 82 and 84, holes 90, 92 and 94 are placed in the enclosures 70 and 74. The holes 90, 92 and 94 are accessed by openings through the back of the buckle 26.

Figure 4:
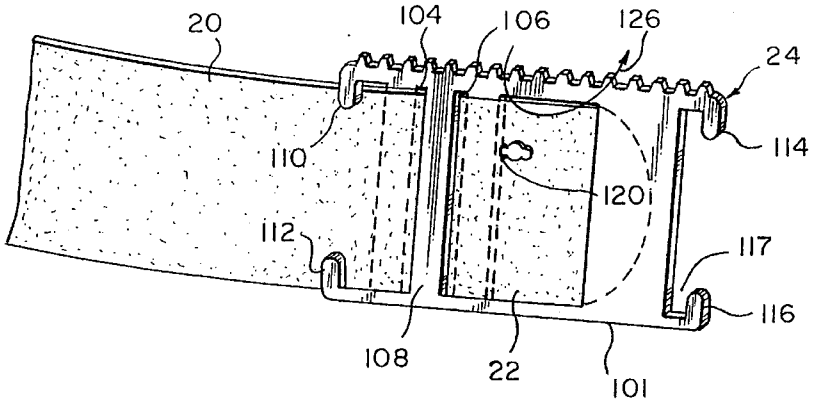
FIG. 4 is a perspective view showing how a first end of the belt of FIG. 1 is initially secured to the slide of FIG. 3.
Figure 3:
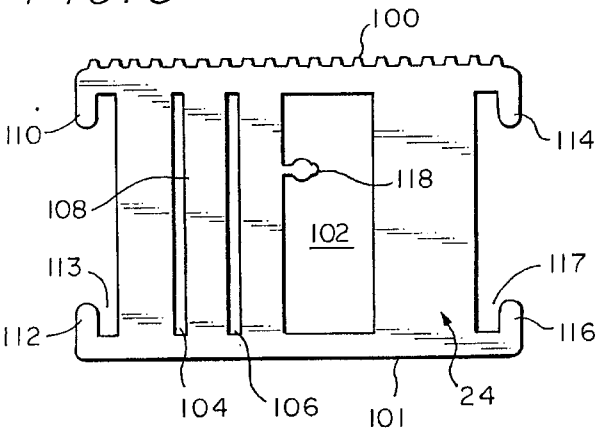
FIG. 3 is a planar view a slide used with the buckle of FIG. 1.
Figure 5:
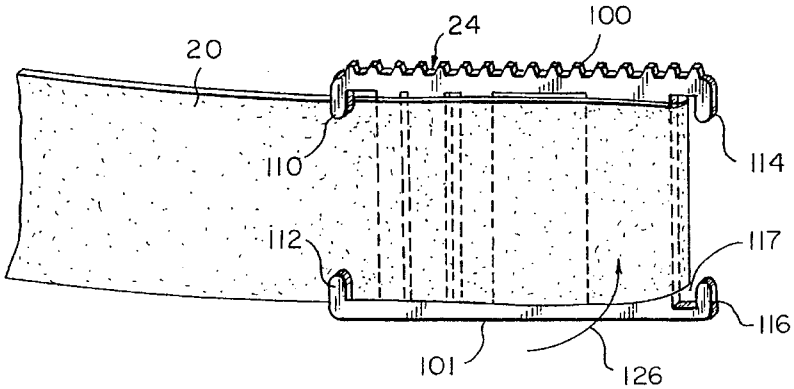
FIG. 5 is a perspective view showing the belt accumulated on the slide of FIG. 3.

Referring now to FIGS. 3–5, the slide 24 which is received in the buckle 26 is shown. The slide 24 is made of plastics and has a row of teeth 100 extending longitudinally across the top source thereof. A recess 102 and a pair of slots 104 and 106 defining a bridge 108 extend laterally across the slide 24. A pair of tabs 110 and 112 define a open slot 113 at one end of the slide 24 while the pair of tabs 114 and 116 define an open slot 117 at the other end. A spike 118 projects into the recess 102. The first end 22 of the belt 20 is initially secured to the slide as is seen in FIG. 4 by being inserted beneath the tabs 110 and 112 so as to pass through the open slot 113. The free end 22 is then passed through the slot 104 and beneath the bridge 108 and then through the slot 106. The end 22 has a hole 120 therein through which the spike 118 projects to hold the belt 20 on the slide 24. The free end (shown in dotted lines) of the first end 22 preferably then fits behind the slide.

In order to select the course length of the belt 20, the belt is accumulated on the slide 24 as is seen in FIG. 5 by rotating the slide in the direction of the arrow 126 so that the belt 20 wraps around the slide and is accumulated thereon. As is seen in FIG. 5, the belt 20 wraps around the rear side of the slide 24 and into the slot 117 defined by the tabs 114 and 116 and thereafter fits beneath the tabs 110 and 112. The open slots 113 and 117 are wide enough to accumulate several wraps of the belt 20 so as to make the initial gross adjustment.

Figure 6:
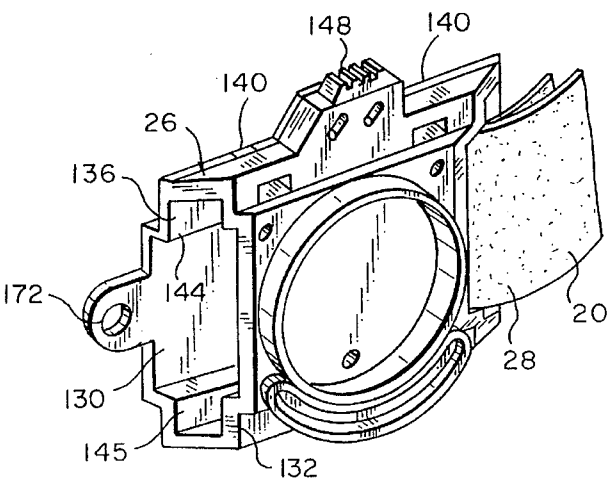
FIG. 6 is a perspective view of the buckle which receives the slide of FIG. 5 therein.

After the belt 20 has been wrapped on the slide 24, it is inserted into the buckle 26 through a channel 130 shown in FIG. 6, which buckle, as is seen in FIGS. 1 and 6, retains the second end 28 of the belt 20.

Figure 7:
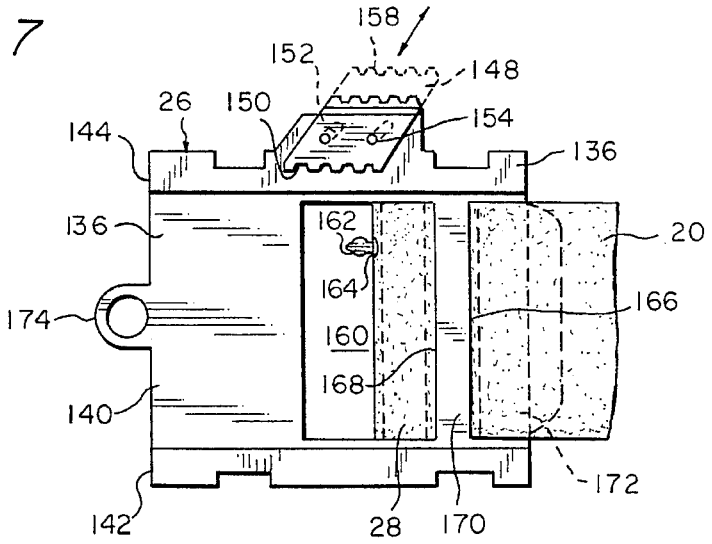
FIG. 7 is a front view of a back portion of the buckle wherein a front portion of the buckle has been removed to show how the buckle operates.
Figure 8:
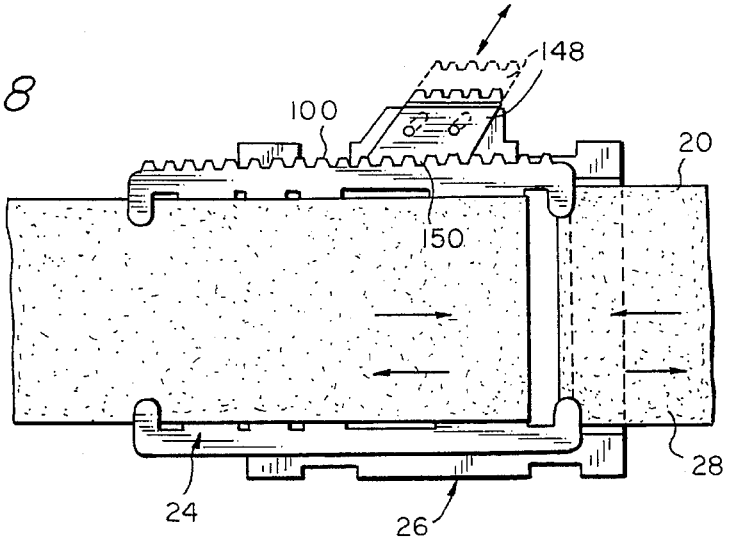
FIG. 8 is a front view showing how the buckle locks the slide therein.

Referring now to FIGS. 7 and 8, in conjunction with FIG. 6, it is seen in FIGS. 7 and 8 that a front cover portion 132 of the belt has been removed so that operation of the buckle can be clearly illustrated. The front cover portion 132 is snapped on to a rear cover portion 136 by detents 140.

As is seen in FIG. 7, the rear portion of the housing 26 includes a recessed portion 140 and a pair of decks 142 and 144. Proximate the deck 144 is a sliding detent 148 with a row of teeth 150. The detent 148 is mounted on the rear panel 136 by a pair of pin and slot connections and 152 and 154 so as to move at an angle with respect to the longitudinal axis of the buckle 26 and the rear panel 136. The detent 148 has a knurled portion 158 on the top surface thereof so that it can be gripped with the players thumbs or fingers. The rear panel 136 includes a rectangular recess 160 which has a spike 162 projecting therein that is received through an opening 164 in the second end 28 of the belt 20. The belt 20 is slid through a pair of slots 166 and 168 and under a bridge 170 between the slots before looping through this rectangular recess 160 and being secured under a bridge 172. An eye 174 projects from one end of the buckle 26 for hanging the belt 20 on a hook when not in use.

Referring now to FIG. 8 in conjunction with FIGS. 5, 6 and 7, it is seen that the slider 24 is pushed into the slot 136 so as to rest on the decks 142 and 144. The detent 148 then engages the teeth 1 00 on the slide 24 with teeth 150 to provide a fine adjustment. Accordingly, the belt 20 has both the course adjustment achieved by wrapping the belt as seen in FIG. 5 and a fine adjustment by selecting the slidable position in which the teeth 150 of the sliding detent 148 engages the teeth 100 on the slide 24.

Figure 9:
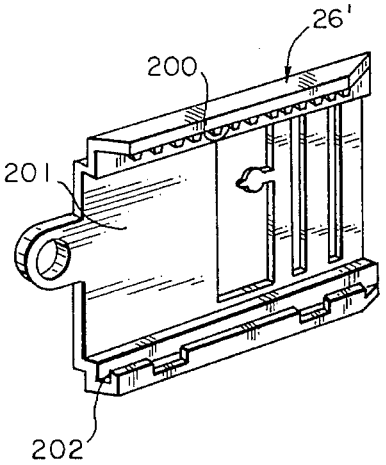
FIG. 9 is a rear perspective view of a second embodiment of a buckle used with the instant invention.
Figure 10:
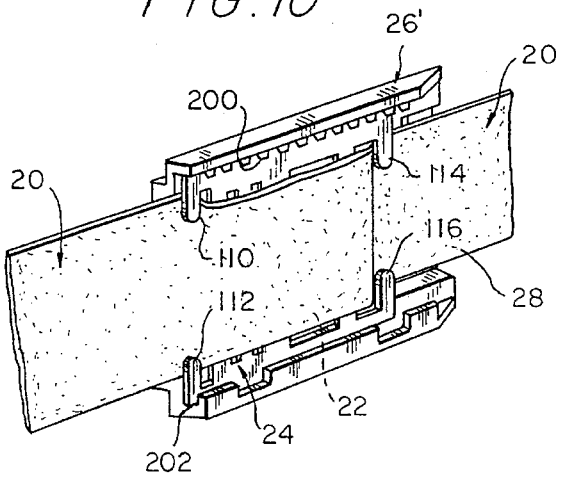
FIG. 10 is a perspective view showing how the buckle of FIG. 9 retains the slide of FIG. 5.

Referring now to FIGS. 9 and 10 where a second embodiment of the buckle 26' is shown, it is seen that the teeth 100 of the slide 24 shown in FIGS. 3–5 are engaged by stationary teeth 200 on the belt buckle 26'. In the embodiment of FIGS. 9 and 10, the buckle 26' has only one panel 201, which panel has a groove 202 at the bottom thereof. The slide 24 is positioned with its bottom edge 101 in the groove 202 and then, as is seen in FIG. 10, simply tilted so that the teeth 200 engage the teeth 100 at a selected position along the slide. This provides sufficient fine adjustment and snugly holds the belt 20 engaged. In the embodiment of FIGS. 9 and 10 there is no need for a second panel, as is the case of the buckle 26 in FIGS. 1 and 6, so as to provide a slot, such as the slot 130, for receiving the slide 24. Accordingly, the arrangement of FIGS. 9 and 10 is less expensive to manufacture. In addition, the arrangement of FIGS. 9 and 10 provides a secure buckling arrangement which is easy for players to use.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. An arrangement used in a flag tag game, the arrangement comprising:

a main support mounted on the body of a player;

a resilient cup-shaped member defining a socket mounted on the main support;

a flag support including a stem with a plunger at one end for detachably seating within the socket on the main support and a web retainer having a pair of slots at its other end;

a flag for mounting on the flag support, the flag having first and second end portions joined by an intermediate portion and having on aperture adjacent said first end portion, the flag being mounted on the flag support by said flag being passed through the slots in said web retainer and receiving said stem through said aperture.

2. The arrangement of claim 1, wherein said aperature has a circular portion which complements the shape of the stem and a slit portion which expands said aperature to allow the plug to be inserted therethrough.

3. The arrangement of claim 2, wherein the slots in the web retainer extend transverse with respect to the stem.

4. The arrangement of claim 1, wherein the slots in the web retainer extend transverse with respect to the stem.

5. The arrangement of claim 1, wherein the support is a belt worn by a player.

* * * * *